US011488533B2

(12) United States Patent
Choi

(10) Patent No.: US 11,488,533 B2
(45) Date of Patent: Nov. 1, 2022

(54) DELAYING ANODE VOLTAGE RESET FOR QUICKER RESPONSE TIMES IN OLED DISPLAYS

(71) Applicant: Google LLC, Mountain View, CA (US)

(72) Inventor: Sangmoo Choi, Palo Alto, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 17/394,953

(22) Filed: Aug. 5, 2021

(65) Prior Publication Data

US 2021/0366398 A1 Nov. 25, 2021

Related U.S. Application Data

(60) Provisional application No. 63/228,784, filed on Aug. 3, 2021.

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2310/08* (2013.01); *G09G 2320/0233* (2013.01); *G09G 2320/0238* (2013.01); *G09G 2320/0252* (2013.01)

(58) Field of Classification Search
None
See application file for complete search history.

(56) References Cited

U.S. PATENT DOCUMENTS

| | | | |
|---|---|---|---|
| 7,675,493 | B2 | 3/2010 | Yoon et al. |
| 9,898,960 | B2 | 2/2018 | Yang et al. |
| 10,068,551 | B1 | 9/2018 | Choi et al. |
| 11,163,970 | B1 | 11/2021 | Sammoura et al. |
| 11,271,181 | B1 * | 3/2022 | Yang ..... H01L 27/156 |
| 2013/0342519 | A1 | 12/2013 | Kim et al. |
| 2014/0292628 | A1 | 10/2014 | Park |
| 2016/0063933 | A1 | 3/2016 | Kobayashi et al. |
| 2016/0078838 | A1 | 3/2016 | Huang et al. |

(Continued)

FOREIGN PATENT DOCUMENTS

| | | |
|---|---|---|
| CN | 111241890 | 6/2020 |
| CN | 111477135 | 7/2020 |

(Continued)

OTHER PUBLICATIONS

Choi, "Clock Trace Structure for Block Sequential Clock Driving", Technical Disclosure Commons, https://www.tdcommons.org/dpubs_series/4786, Dec. 19, 2021, 11 pages.

(Continued)

*Primary Examiner* — Christopher J Kohlman
(74) *Attorney, Agent, or Firm* — Colby Nipper PLLC

(57) ABSTRACT

This document describes systems and techniques for delaying anode voltage reset for quicker response times in organic light-emitting diode (OLED) displays. In an aspect, a pixel circuit includes a transistor electrically connected to an anode of an organic light-emitting diode and a reset voltage. Upon receiving an anode reset signal, the transistor completes the circuit causing the anode voltage to reset to the reset voltage in an anode voltage reset process. Delaying anode voltage reset can hasten response times in OLED displays.

13 Claims, 5 Drawing Sheets

(56) References Cited

U.S. PATENT DOCUMENTS

| | | | | |
|---|---|---|---|---|
| 2016/0078846 | A1 | 3/2016 | Liu et al. | |
| 2016/0210923 | A1 | 7/2016 | Yoshida et al. | |
| 2017/0004760 | A1 | 1/2017 | Jang et al. | |
| 2017/0092196 | A1 | 3/2017 | Gupta et al. | |
| 2018/0151109 | A1 | 5/2018 | Shim et al. | |
| 2018/0277051 | A1 | 9/2018 | Du | |
| 2018/0301080 | A1 | 10/2018 | Shigeta et al. | |
| 2019/0180691 | A1 | 6/2019 | Takasugi | |
| 2019/0228740 | A1 | 7/2019 | Aflatooni et al. | |
| 2020/0020271 | A1* | 1/2020 | Watsuda | G09G 3/2074 |
| 2020/0226978 | A1 | 7/2020 | Lin et al. | |
| 2020/0273427 | A1 | 8/2020 | Wang | |
| 2021/0201731 | A1 | 7/2021 | Ranjan et al. | |
| 2021/0408140 | A1 | 12/2021 | Han et al. | |

FOREIGN PATENT DOCUMENTS

| | | |
|---|---|---|
| CN | 112037716 | 12/2020 |
| CN | 112331145 | 2/2021 |
| CN | 112397030 | 2/2021 |
| CN | 113053306 | 6/2021 |

OTHER PUBLICATIONS

Choi, et al., "Dynamically Altering Clock Signal Frequencies in LTPO AMOLED Displays", Technical Disclosure Commons, https://www.tdcommons.org/dpubs_series/4652, Oct. 12, 2021, 11 pages.

Shin, et al., "Dynamic Voltage Scaling of OLED Displays", Jun. 2011, 6 pages.

Yonebayashi, et al., "High refresh rate and low power consumption AMOLED panel using top-gate n-oxide and p-LTPS TFTs", Mar. 2020, 10 pages.

Youn, et al., "Image Data Compensation to Prevent Display Artifacts on an OLED Display", Technical Disclosure Commons, https://www.tdcommons.org/dpubs_series/4615, Sep. 23, 2021, 8 pages.

Choi, et al., "Expediting Fingerprint Authentication by Compensating for Display Luminance Latency", Technical Disclosure Commons, https://www.tdcommons.org/dpubs_series/4686, Oct. 29, 2021, 11 pages.

Wen, et al., "Improving Under-Display Fingerprint Authentication Latency by Normalizing Frame Luminance", Technical Disclosure Commons—https://www.tdcommons.org/dpubs_series/5006, Mar. 24, 2022, 12 pages.

* cited by examiner

DELAYING ANODE VOLTAGE RESET FOR QUICKER RESPONSE TIMES IN OLED DISPLAYS

RELATED APPLICATION

This application claims priority to U.S. Provisional Patent Application Ser. No. 63/228,784 filed on Aug. 3, 2021, the disclosure of which is incorporated by reference herein in its entirety.

SUMMARY

This document describes systems and techniques for delaying anode voltage reset for quicker response times in organic light-emitting diode (OLED) displays. In an aspect, a pixel circuit includes a transistor electrically connected to an anode of an organic light-emitting diode and a reset voltage. Upon receiving an anode reset signal, the transistor completes the circuit causing the anode voltage to reset to the reset voltage ("anode voltage reset"). In some circumstances, including OLED displays at low luminance, resetting the anode voltage at the beginning of a frame may slow light emission of an organic light-emitting diode ("response time") causing noticeable optical artifacts, including motion blur. Therefore, to hasten response times in OLED displays, it is desirable to delay anode voltage reset at intervals other than the beginning of a frame.

This Summary is provided to introduce simplified of concepts systems and techniques for delaying anode voltage reset for quicker response times in OLED displays, the concepts of which are further described below in the Detailed Description and Drawings. This Summary is not intended to identify essential features of the claimed subject matter, nor is it intended for use in determining the scope of the claimed subject matter.

BRIEF DESCRIPTION OF THE DRAWINGS

The details of one or more aspects of systems and techniques for delaying anode voltage reset for quicker response times in OLED displays are described in this document with reference to the following drawings.

The same numbers are used throughout the Drawings to reference like features and components.

DETAILED DESCRIPTION

Overview

This document describes systems and techniques for delaying anode voltage reset for quicker response times in OLED displays. Many electronic devices (e.g., smartphones, tablets, virtual-reality (VR) goggles) include displays. Such displays often use organic light-emitting diode (OLED) technology, utilizing tens of thousands of pixel circuits each having their own organic light-emitting diode. The benefits of OLED displays include high refresh rates, small display response times, and low power consumption. These benefits make OLED displays well-suited for electronic devices, in large part because users appreciate the display image-quality.

In some circumstances, for instance OLED displays at low luminance, OLED displays may have slightly delayed light emission. Such a delay may cause noticeable optical artifacts including motion blur. Electronic device users, who oftentimes prize OLED displays for the image-quality, may desire quicker response times in OLED displays.

Example Environment

Figure 1:
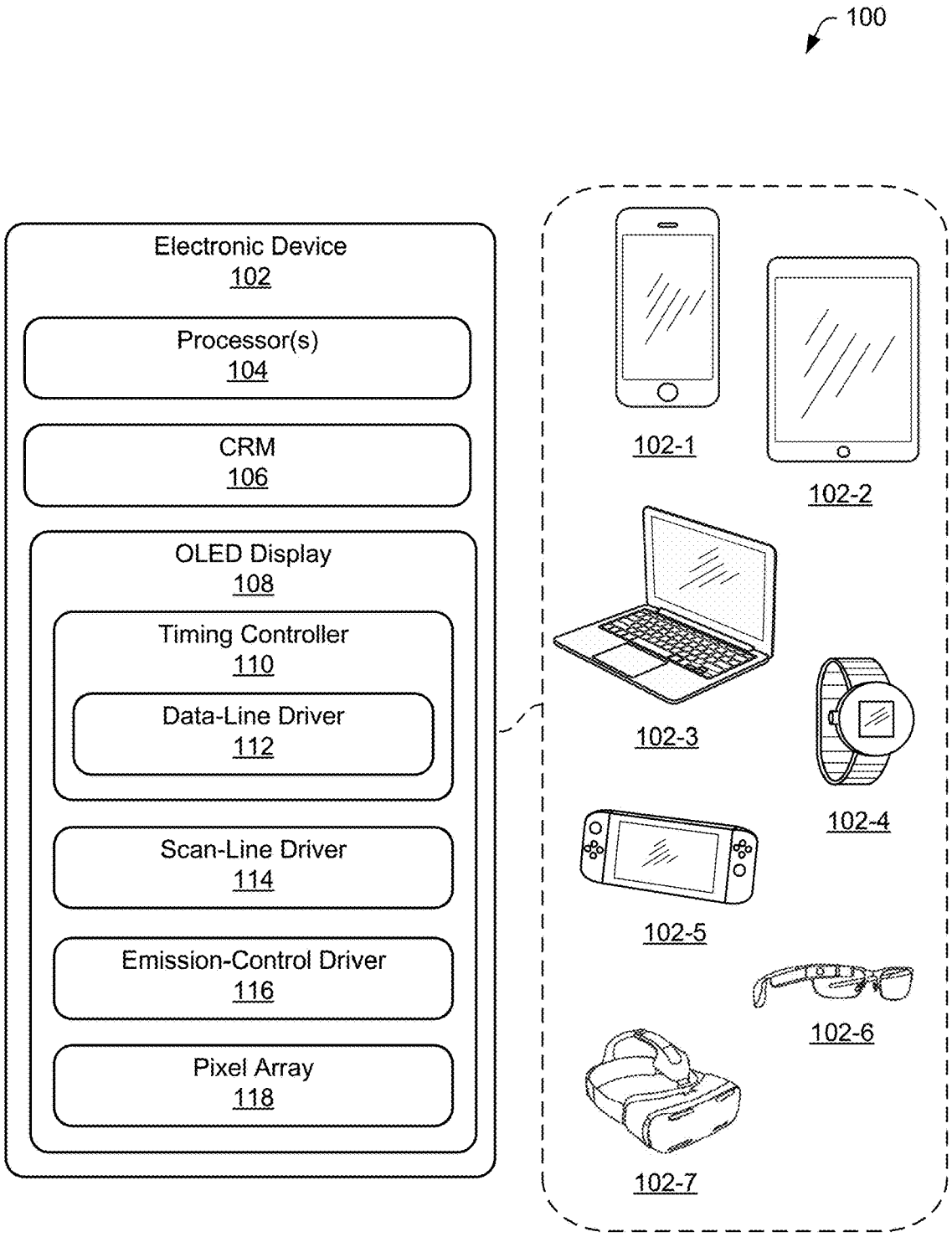
FIG. 1 illustrates an example device diagram of an electronic device in which delaying anode voltage reset for quicker response times in OLED displays can be implemented.

FIG. 1 illustrates an example device diagram 100 of an electronic device 102 in which delaying anode voltage reset for quicker response times in an OLED display 108 can be implemented. The electronic device 102 may include additional components and interfaces omitted from FIG. 1 for the sake of clarity. The electronic device 102 can be a variety of consumer electronic devices. As non-limiting examples, the electronic device 102 can be a mobile phone 102-1, a tablet device 102-2, a laptop computer 102-3, a computerized watch 102-4, a portable video game console 102-5, smart glasses 102-6, VR goggles 102-7, and the like.

The electronic device 102 includes one or more processors 104 operably connected to a timing controller 110. The processor(s) 104 can include, as non-limiting examples, a system on a chip (SoC), an application processor (AP), a central processing unit (CPU), or a graphics processing unit (GPU). The processor(s) 104 generally execute commands and processes utilized by the electronic device 102 and an operating system installed thereon. For example, the processor(s) 104 may perform operations to display graphics of the electronic device 102 on the OLED display 108 and can perform other specific computational tasks, such as controlling the creation and display of an image on the OLED display 108.

The electronic device 102 also includes computer-readable storage media (CRM) 106. The CRM 106 is a suitable storage device (e.g., random-access memory (RAM), static RAM (SRAM), dynamic RAM (DRAM), non-volatile RAM (NVRAM), read-only memory (ROM), flash memory) configured to store device data of the electronic device 102, user data, and multimedia data. The CRM may store an operating system that generally manages hardware and software resources (e.g., the applications) of the electronic device 102 and provides common services for applications stored on the CRM. The operating system and the applications are generally executable by the processor(s) 104 to enable communications and user interaction with the electronic device 102.

The electronic device 102 further includes an OLED display 108. The OLED display 108 includes a pixel array 118 of pixel circuits, which is controlled by a timing controller 110, a data-line driver 112, a scan-line driver 114, and an emission-control driver 116. In other implementations, a timing controller 110 and a plurality of scan-line drivers, data-line drivers, and emission-control drivers may control the pixel circuits of a pixel array 118. As illustrated in FIG. 1, the timing controller 110 includes the data-line driver 112. In other implementations, the data-line driver 112 may be a separate component operably connected to the timing controller 110.

The timing controller 110 provides interfacing functionality between the processor(s) 104 and the drivers (e.g., data-line driver 112, scan-line driver 114, emission-control driver 116) of the OLED display 108. The timing controller 110 generally accepts commands and data from the processor(s) 104, generates signals with appropriate voltage, current, timing, and demultiplexing, and passes the signals to the data-line driver 112, the scan-line driver 114, and the emission-control driver 116 to enable the OLED display 108 to show the desired image.

The drivers may pass time-variant and amplitude-variant signals (e.g., voltage signals, current signals) to control the pixel array 118. For example, the data-line driver 112 passes signals containing voltage data to the pixel array 118 to control the luminance of an organic light-emitting diode. The scan-line driver 114 passes a signal to enable or disable an organic light-emitting diode to receive the data voltage from the data-line driver 112. The emission-control driver 116 supplies an emission-control signal to the pixel array 118. Together, the drivers control the pixel array 118 to generate light to create an image on the OLED display 108.

Figure 2:
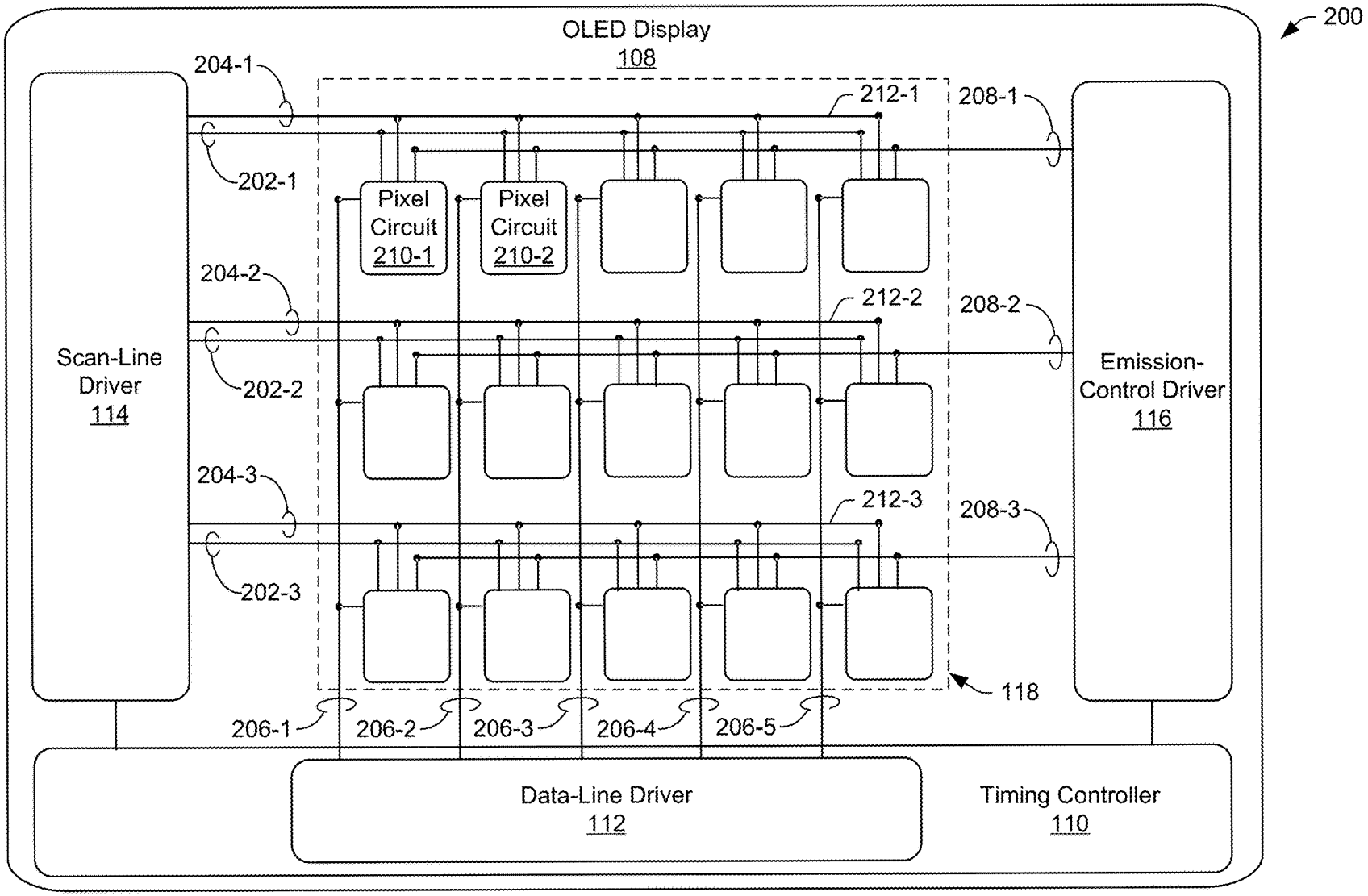
FIG. 2 illustrates an example device diagram of an OLED display in which delaying anode voltage reset can be implemented.

FIG. 2 illustrates an example device diagram 200 of the OLED display 108 in which delaying anode voltage reset for quicker response times in OLED displays can be implemented. In this example, the OLED display 108 includes similar components to those described and illustrated with respect to the OLED display 108 of FIG. 1, with some additional detail. The OLED display 108 can include additional components, which are not illustrated in FIG. 2. Further, in other implementations, the electronic device 102 may utilize a display other than an OLED display 108, including a liquid crystal display (LCD), a plasma monitor panel (PDP), and the such.

The OLED display 108 includes a pixel array 118, also shown in FIG. 1, and scan signals 202 (e.g., scan signal 202-1, scan signal 202-2, scan signal 202-3), anode reset signals 204 (e.g., anode reset signal 204-1, anode reset signal 204-2, anode reset signal 204-3), data signals 206 (e.g., data signal 206-1, data signal 206-2, data signal 206-3, data signal 206-4, data signal 206-5), emission-control signals 208, and pixel circuits 210 (e.g., pixel circuit 210-1, pixel circuit 210-2) arranged in the pixel array 118. The OLED display 108 may contain a plurality (e.g., hundreds, thousands, millions) of pixel circuits 210, but only fifteen pixel circuits 210 are illustrated in FIG. 2. The scan-line driver 114 may generate and supply the scan signals 202 to the pixel circuits 210 in the pixel array 118 over rows of scan lines. For example, the scan-line driver 114 generates and supplies the scan signal 202-1 to pixel circuits 210 of a first row of scan lines. The scan-line driver 114 may be further configured to generate and supply anode reset signals 204 to the pixel circuits 210 in the pixel array 118 over rows of anode reset lines 212 (e.g., anode reset line 212-1, anode reset line 212-2, anode reset line 212-3). For example, the scan-line driver 114 generates and supplies the anode reset signal 204-1 to pixel circuits 210 of a first row of anode reset lines 212-1. The data-line driver 112 may generate and supply the data signals 206 to the pixel circuits 210 in the pixel array 118 over columns of data lines to control the luminance of an organic light-emitting diode in a pixel circuit 210 (e.g., pixel circuit 210-1). For example, the data-line driver 112 generates and supplies the data signal 206-1 to pixel circuits 210 in the pixel array 118 of a first column of data lines. The emission-control driver 116 may generate and supply the emission-control signals 208 (e.g., emission-control signal 208-1, emission-control signal 208-2, emission-control signal 208-3) to pixel circuits 210 in the pixel array 118 over rows of emission-control lines. For example, the emission-control driver 116 generates and supplies the emission-control signal 208-1 to pixel circuits 210 in the pixel array 118 of a first row of emission-control lines.

Figure 3:
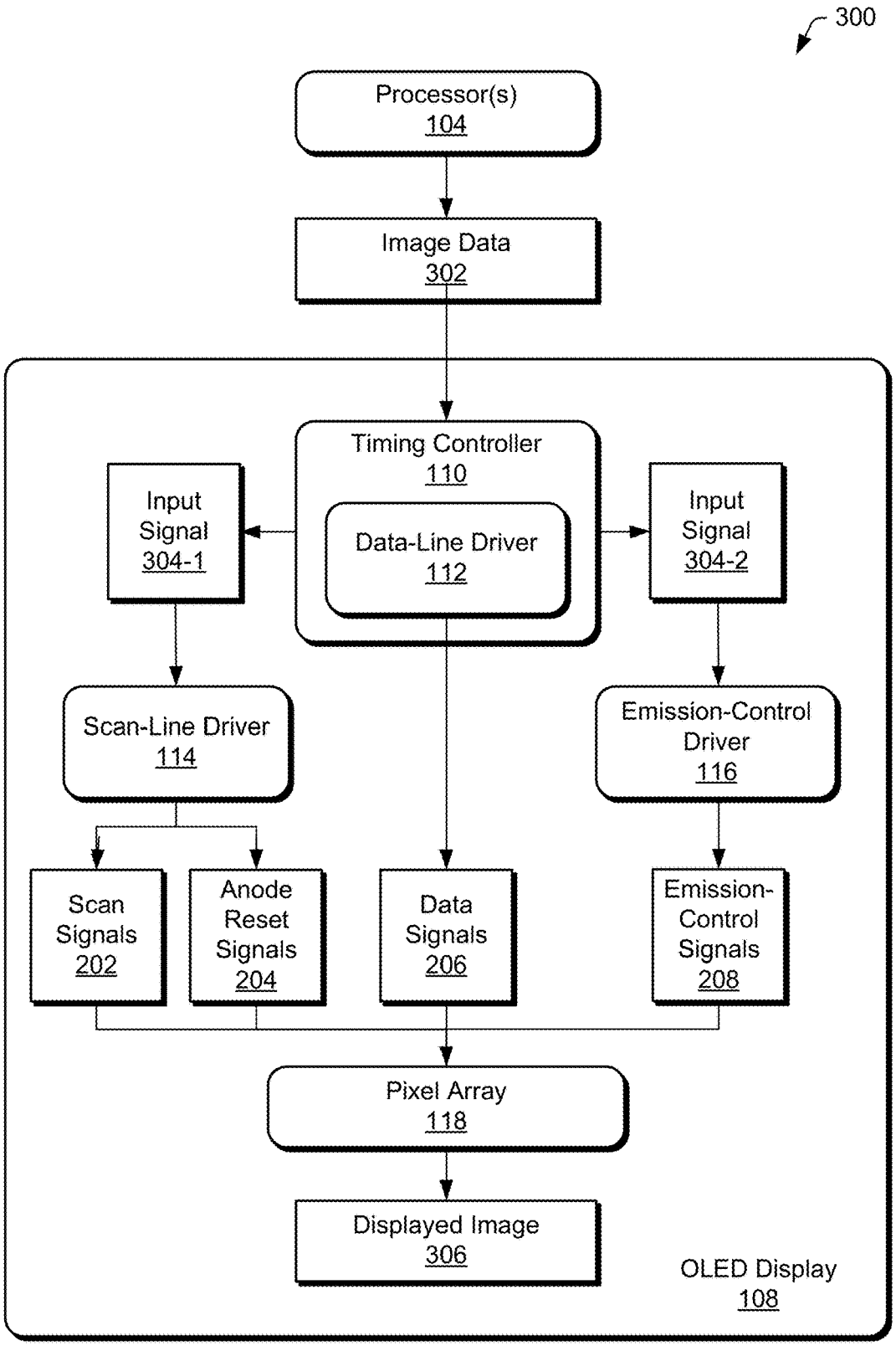
FIG. 3 is a schematic view illustrating example elements of an electronic device configured to receive, generate, and/or supply signals to produce a displayed image on an OLED display.

FIG. 3 is a schematic view 300 illustrating example elements of an electronic device 102 configured to receive, generate, and/or supply signals to produce a displayed image 306 on an OLED display 108. The schematic view 300 is shown as a set of components and outputs (e.g., signals, data) thereof, but are not necessarily limited to the order or combinations shown. In portions of the following discussion, the schematic view 300 is described in the context of the OLED display 108 of FIGS. 1 and 2, or to entities or processes as detailed in other figures, reference to which is made for example only. The schematic view 300 may include outputs in a different order or with additional or fewer components and outputs thereof. Further, any of one or more of the outputs of schematic view 300 may be repeated, combined, reorganized, or linked to provide a wide array of additional and/or alternate outputs.

As described with respect to FIG. 1, the electronic device 102 includes processor(s) 104 to control the creation and display of a displayed image 306 on the OLED display 108. As illustrated in FIG. 3, the processor(s) 104 transmit image data 302 to the timing controller 110. The image data 302 includes information regarding the displayed image 306. The timing controller 110 may process the image data 302 and generate input signals 304 (e.g., input signal 304-1, input signal 304-2). The timing controller 110 may supply an input signal 304-1 to the scan-line driver 114 and an input signal 304-2 to the emission-control driver 116.

The scan-line driver may generate and supply scan signals 202 and anode reset signals 204 to the pixel circuits 210 within the pixel array 118 through the scan lines and anode reset lines 212, respectively, as illustrated in FIG. 2, for example. The data-line driver may generate and supply data signals 206 to the pixel circuits 210 within the pixel array 118 through the data lines, as illustrated in FIG. 2, for example. The emission-control driver 116 may generate and supply emission-control signals 208 to the pixel circuits 210 within the pixel array 118 through the emission-control lines, as illustrated in FIG. 2, for example.

Figure 4:
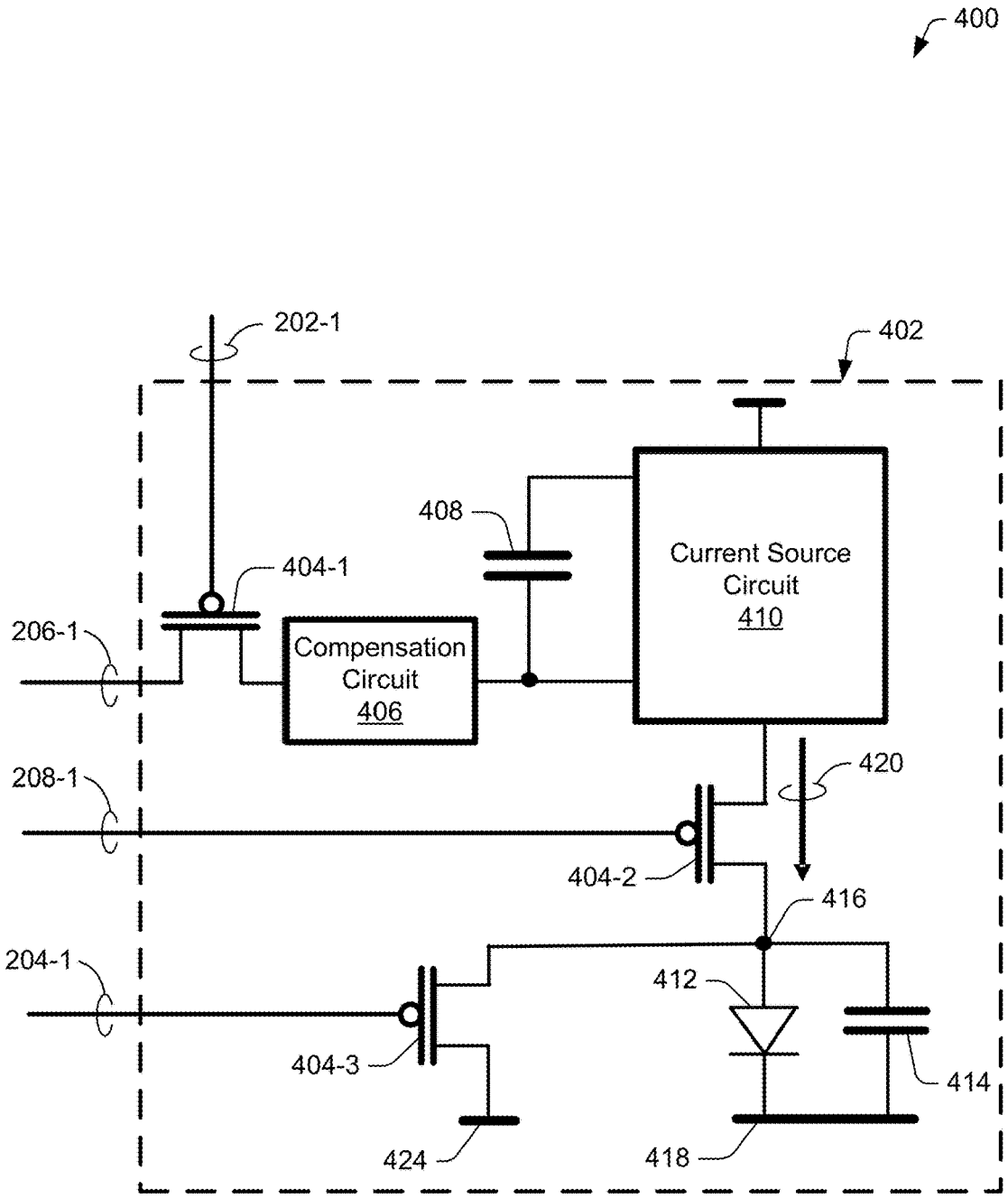
FIG. 4 is an example pixel circuit.

FIG. 4 illustrates a pixel circuit 402 as an example detailed circuit diagram 400. In the circuit diagram 400, the pixel circuit 402 is similar to the pixel circuit 210-1 described with respect to FIG. 2, with some additional detail. The pixel circuit 402 can include additional components, which are not illustrated in FIG. 4. The pixel circuit 402 may be implemented in the OLED display 108 of the electronic device 102.

The pixel circuit 402 may contain circuit elements including thin-film transistors (TFTs) 404 (e.g., TFT 404-1, TFT 404-2, TFT 404-3), a compensation circuit 406, a capacitor 408, a current source circuit 410, and an organic light-emitting diode 412. In other implementations, the pixel circuit 402 may include operational amplifiers (Op Amps), as well as other electronic switches including bipolar junction transistors (BJTs) and insulated gate bipolar transistors (IGBTs). The TFTs 404 may be p-channel and/or n-channel metal-oxide-semiconductor field-effect transistors (MOSFETs) having thin films of an active semiconductor layer and a dielectric layer, as well as metallic contacts over a supporting substrate. In operation, these TFTs 404 function as a series of switches, enabling or disabling current to flow through the pixel circuit 402 (e.g., pixel circuit 210-1) to the organic light-emitting diode 412 based on the values of the driver signals (e.g., scan signal 202-1, anode reset signal 204-1, data signal 206-1, and emission-control signal 208-

1). For example, TFT 404-2 may be a p-channel MOSFET, enabling current flow when the emission-control signal 208-1 has a low voltage.

In another example, the data-line driver (e.g., data-line driver 112) can send the data signal 206-1 to the pixel circuit 402 (and the other pixel circuits operatively coupled to the data-line driver). The scan-line driver (e.g., scan-line driver 114) can pass the scan signal 202-1 to the pixel circuit 402 (and other pixel circuits operatively coupled to the scan-line driver) to activate TFT 404-1 (e.g., close the switch), and thereby enable the pixel circuit (e.g., pixel circuit 210-1) to receive the data signal 206-1. If the scan-line driver passes a scan signal 202-1 to the pixel circuit 402 to deactivate TFT 404-1 (e.g., open the switch), then the pixel circuit 402 does not receive the data signal 206-1. In this manner, the pixel circuits within the pixel array can receive data signals to enable the generation of a displayed image for the next frame.

Further to the above descriptions, the organic light-emitting diode 412 possesses a native capacitance, which is illustrated in FIG. 4 as separate from, but electrically parallel to, the organic light-emitting diode 412 as a capacitor 414 ($C_{OLED}$ 414). As a result, the organic light-emitting diode 412 possesses an anode 416 and a cathode 418 schematically shared by $C_{OLED}$ 414. As the electric potential difference between the anode 416 and the cathode 418 ("$C_{OLED}$ voltage level") increases, a threshold voltage level is exceeded such that the organic light-emitting diode 412 starts to emit light.

Due to the non-ideal properties of transistors, leakage current 420 from the current source circuit 410 undesirably increases the $C_{OLED}$ voltage level even when the data signal 206-1 contains voltage data programmed for the organic light-emitting diode 412 to remain dark ("black voltage data"). This, in conjunction with the high-efficiency of the organic light-emitting diode 412, may result in the organic light-emitting diode 412 emitting light ("boosted black luminance") when it should remain dark. This boosted black luminance decreases the contrast ratio and the overall quality of the OLED display.

To eliminate the boosted black luminance, the electronic device 102 may implement a series of operations, referred to herein as anode voltage reset. In a first operation, the processor(s) 104 direct the timing controller 110 to generate and pass an input signal to the scan-line driver 114 to generate the anode reset signal 204. The scan-line driver 114 may generate the anode reset signal 204 that is similar to the scan signal 202 except that the waveform of the anode reset signal 204 is time-shifted (e.g., time-delayed, time-advanced), such as by a predetermined number of milliseconds. In another implementation, the OLED display 108 may include an additional driver that the timing controller 110 directs to generate the anode reset signal 204. In a second operation, the anode reset signal 204 is passed through anode reset lines 212 into the pixel array 118 to the pixel circuit 402. The anode reset signal 204 may be a voltage with high or low values.

In a third operation, the anode reset signal 204 activates an anode reset TFT 404-3. The anode reset signal 204 may be configured to activate the anode reset TFT with a high or low voltage. In the following description, the anode reset TFT 404-3 is described as being activated by a low-voltage type of the anode reset signal 204. Activation of the anode reset TFT 404-3 causes the anode 416 voltage to reset to a reset voltage 424. As a result, the $C_{OLED}$ voltage level is initialized substantially low enough to ensure the organic light-emitting diode 412 does not emit light if the data signal 206-1 contains black voltage data. The above description of an anode voltage reset was provided in reference, as an example, to pixel circuit 402, but the series of operations should be understood as being applicable to any of the pixel circuits 210 in the pixel array 118, as illustrated in FIG. 1 and FIG. 2.

The described techniques for anode voltage reset enable the OLED display 108 to maintain a low black luminance but may reduce the response time (e.g., the passage of time from when the pixel circuit received a data signal to when the organic light-emitting diode 412 starts to emit light) in certain circumstances. One such circumstance includes when the data signal 206 contains data voltage programmed for low luminance ("low-luminance voltage data"). For example, the pixel circuit 402 may receive a data signal 206-1 containing black voltage data for a first frame. The pixel circuit 402 may then receive an anode reset signal 204 to reset the anode 416 voltage. Successive to the black voltage data for the first frame, the pixel circuit 402 may then receive a data signal 206-1 containing low-luminance voltage data for a second frame. Due to the anode 416 voltage being reset to the reset voltage 424 immediately before receiving the low-luminance voltage data, the $C_{OLED}$ voltage level is too low for the organic light-emitting diode 412 to emit light immediately. The slow light emission of the organic light-emitting diode 412 may cause noticeable optical artifacts, including motion blur. To address slow response times in OLED displays 108, the timing controller 110 may direct the scan-line driver to delay passing the anode reset signal 204 ("delayed anode voltage reset") such that the anode 416 voltage is reset to the reset voltage 424 at a later interval.

Figure 5:
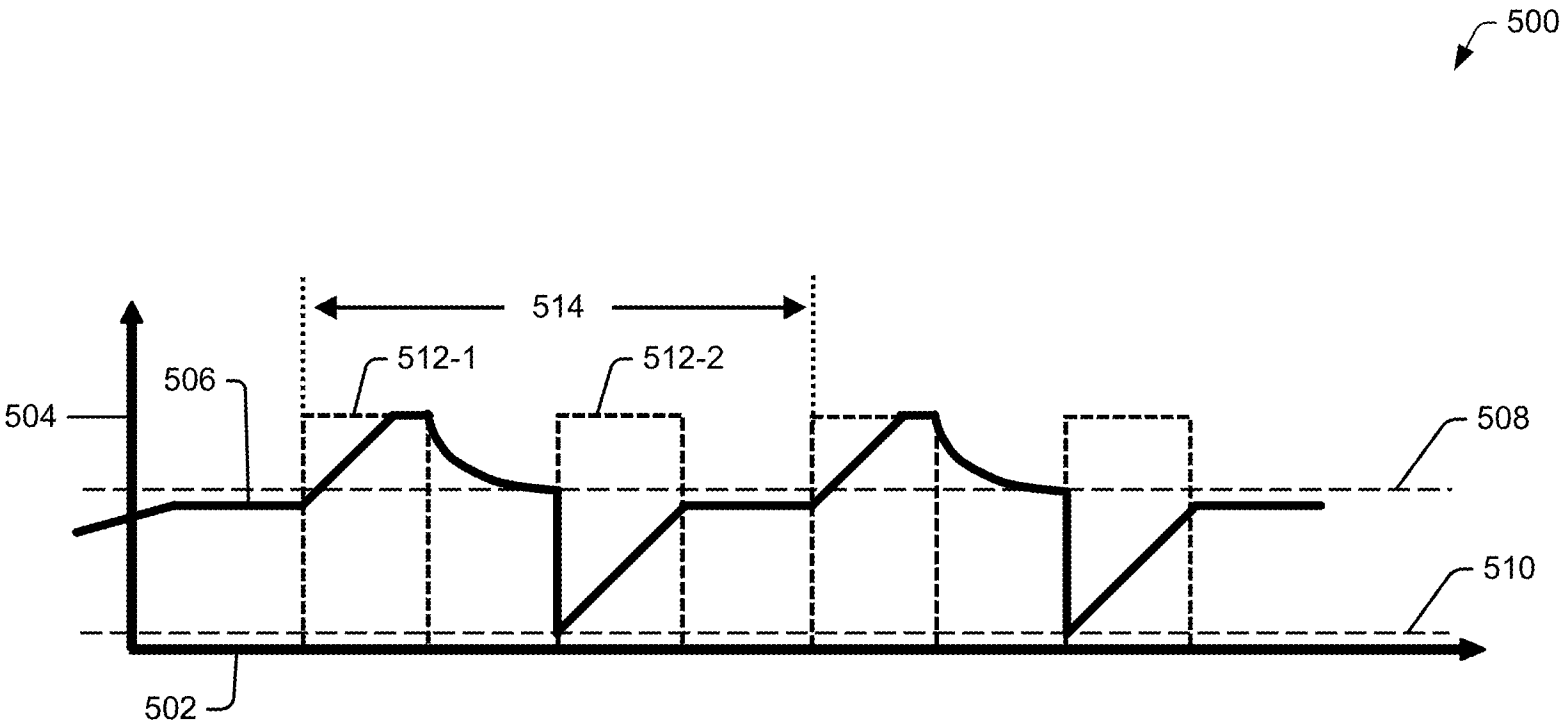
FIG. 5 is a graphical illustration of an anode voltage of an example pixel circuit implementing delaying anode voltage reset for quicker response times in OLED displays.

FIG. 5 graphically illustrates an anode voltage (e.g., the voltage level of anode 416 of FIG. 4) of a pixel circuit (e.g., pixel circuit 402) implementing a delayed anode voltage reset to hasten the response times in OLED displays (e.g., OLED display 108 of FIG. 1). FIG. 5 illustrates a graph 500 with an x-axis 502 representing time in seconds and y-axis 504 representing the anode voltage. FIG. 5 also illustrates the graph having a voltage signal 506, a threshold voltage level 508, and a reset voltage level 510. The threshold voltage level 508 is the voltage level at which the organic light-emitting diode (e.g., the organic light-emitting diode 412 of FIG. 4) starts to emit light. The reset voltage level 510 is the graphical illustration of the reset voltage (e.g., the reset voltage 424 of FIG. 4) at which the anode voltage is reset. FIG. 5 further illustrates two emission cycles 512 (e.g., emission cycle 512-1, emission cycle 512-2) per a display frame period 514.

The number of frames per second ("frame rate"), and by extension the display frame period 514, is determined by the one or more processors (e.g., processor(s) 104 of FIG. 1). For example, a CPU may send information or instructions from software resources (e.g., programs, applications) to a GPU to implement a frame rate and a corresponding display-frame period 514. The number of emission cycles 512 per a display-frame period 514 is determined by the one or more processors and implemented by the timing controller (e.g., timing controller 110 of FIG. 1). The timing controller may generate and pass an input signal (e.g., the input signal 304 of FIG. 3) to the emission-control driver (e.g., emission-control driver 116 of FIG. 1) for triggering the generation of emission-control signals (e.g., emission-control signals 208 of FIG. 2). When the emission-control driver passes high emission-control signals to the pixel circuits (e.g., pixel circuits 210 of FIG. 2) in the pixel array (e.g., the pixel array 118 of FIG. 1), emission-control TFTs (e.g., TFT 404-2) in the pixel circuits in the pixel array deactivate. Correspondingly, when the emission-control driver passes low (e.g., values smaller than the high signal including zero or negative numbers) emission-control signals to the pixel circuits in the pixel array, the emission-control TFTs in the pixel circuits activate, enabling the anode voltage to increase proportionately to the data voltage of the data signal. The number of times the emission-control driver passes low emission-control signals per a display-frame period 514 determines the number of emission cycles 512. For example, if the frame rate of an OLED display is 120 hertz, then the display-frame period 514 may be 0.0083 seconds. To achieve two emission cycles 512 per a 0.0083 second display-frame period 514, the emission-control driver may pass a high emission-control signal for 2.07 milliseconds and then a low emission-control signal for 2.07 milliseconds, twice in one display-frame period 514. The electronic device may utilize an OLED display configured for a frame rate of 60 hertz and/or 120 hertz. Further, the timing controller may implement any number of emission cycles 512. For example, the timing controller may implement six emission cycles 512 in one display-frame period 514.

As illustrated in FIG. 5, within the display-frame period 514, the voltage signal 506 starts below the threshold voltage level 508. Once the emission-control driver passes a low emission-control signal to the pixel circuit (indicated by emission cycle 512-1), the emission-control TFT activates resulting in the anode voltage increasing (indicated by the voltage signal 506 increasing). The anode voltage increases for the duration of the low emission-control signal, causing the organic light-emitting diode to emit light. Graphically illustrated in FIG. 5, the voltage signal 506 increases during the emission cycle 512-1 and exceeds the threshold voltage level 508.

After the emission cycle 512-1, the emission-control driver then passes a high emission-control signal to the pixel circuit, causing the emission-control TFT to deactivate. Deactivation of the emission-control TFT prevents current from flowing to the organic light-emitting diode, resulting in the organic light-emitting diode to discharge exponentially, similar to that of a capacitor, until it no longer emits light. Graphically illustrated in FIG. 5, the voltage signal 506 decreases exponentially until reaching the threshold voltage level 508.

Halfway in the display-frame period 514, the anode reset signal (e.g., anode reset signal 204 of FIG. 4) is passed into the pixel array to the pixel circuits. The anode reset signal activates the anode reset TFT (e.g., TFT 404-3 of FIG. 4) causing the anode to reset to the reset voltage. Graphically illustrated in FIG. 5, the voltage signal 506 drops to the reset voltage level 510.

The emission-control driver then passes a second, low emission-control signal, causing the anode voltage to increase for the duration of the low emission-control signal. Since the anode voltage was reset to the reset voltage and the low-luminance voltage data is too low, the organic light-emitting diode does not emit light. Graphically illustrated in FIG. 5, the voltage signal 506 increases during the emission cycle 512-2 but does not exceed the threshold voltage level 508. The emission-control driver then passes a second, high emission-control signal to the pixel circuit, causing the emission-control TFT to deactivate. Deactivation of the emission-control TFT prevents current flow to the organic light-emitting diode. As a result, the anode voltage remains constant. Graphically illustrated in FIG. 5, the voltage signal 506 plateaus until the end of the display-frame period 514.

The above descriptions of delayed anode reset should be understood as being applicable to any pixel circuit in the pixel array of the OLED display of an electronic device. Further to the above descriptions, the low anode reset signal may be passed to the pixel circuits in the pixel array at times other than half of the display-frame period. For example, the delayed anode reset signal may be passed to the pixel array by a partial display-frame period at ⅙ of the display-frame period. Further, a low anode reset signal can be passed to the pixel circuits in the pixel array for a variable duration during an emission duty cycle. For example, if the emission-control driver passes four, high emission-control signals to the pixel array producing four emission cycles, then a low anode reset signal can be passed during any one of the high emission-control signals. Depending on the data voltage of the data signal (e.g., data signals 206 of FIG. 2), the one or more processors can direct the timing controller to implement passing the anode reset signal at different time intervals to optimize light emission.

Delaying anode voltage reset by passing the anode reset signal at later time intervals in the display-frame period enables the organic light-emitting diode to start light emission immediately after new image data is programmed. As a result, response times can be hastened, eliminating noticeable optical artifacts including motion blur.

What is claimed is:

1. A display comprising:

a pixel array including multiple pixel circuits, each of the multiple pixel circuits connected to an emission-control line, a data line, a scan line, and an anode reset line;

an emission-control driver configured to generate and supply an emission-control signal, through the emission-control line, to the one or more pixel circuits of the multiple pixel circuits, the emission-control signal configured to produce a first emission cycle and a second emission cycle;

a data-line driver configured to generate and supply a data signal, through the data line, to the one or more pixel circuits of the multiple pixel circuits during at least one of the first emission cycle or the second emission cycle;

a scan-line driver configured to generate and supply a scan signal, through the scan line, to the one or more pixel circuits of the multiple pixel circuits during at least one of the first emission cycle or the second emission cycle; and the scan-line driver further configured to:

generate and supply an anode reset signal during the second emission cycle, through the scan line or an anode reset line, to the one or more pixel circuits of the multiple pixel circuits, the anode reset signal configured to:

reset, during a display-frame period, an anode voltage of the one or more pixel circuits of the multiple pixel circuits to a reset voltage less than a threshold voltage, the reset of the anode voltage being delayed until the second emission cycle effective to decrease a delay in an emission of light by the one or more of the multiple pixel circuits.

2. The display of claim 1, wherein the display-frame period comprises two emission cycles.

3. The display of claim 2, wherein the reset of the anode voltage is delayed ½ of the display-frame period.

4. The display of claim 1, wherein the display-frame period comprises four emission cycles.

5. The display of claim 4, wherein the scan-line driver is further configured to generate and supply a second anode reset signal during a fourth emission cycle.

6. The display of claim 5, wherein the reset of the anode voltage is delayed ¼ of the display-frame period.

7. The display of claim 1, wherein the display-frame period comprises six emission cycles.

8. The display of claim 7, wherein the scan-line driver is further configured to generate and supply an anode reset signal for at least one of a fourth emission cycle or a sixth emission cycle.

9. The display of claim 8, wherein the reset of the anode voltage is delayed at least ⅙ of the display-frame period.

10. The display of claim 1, wherein the reset of the anode voltage is delayed until during the second emission cycle, the reset of the anode voltage being for a variable duration during the second emission cycle.

11. The display of claim 10, wherein the variable duration is based at least in part on a data voltage of the data signal generated and supplied by the data-line driver.

12. The display of claim 1, further comprising an additional driver, the additional driver configured to supply, to the scan-line driver, the anode reset signal.

13. The display of claim 1, wherein the display comprises an organic light-emitting diode (OLED) display.

* * * * *